US007172852B2

(12) United States Patent
Geuens et al.

(10) Patent No.: US 7,172,852 B2
(45) Date of Patent: Feb. 6, 2007

(54) THERMOGRAPHIC RECORDING MATERIAL WITH IMPROVED DEVELOPABILITY

(75) Inventors: Ingrid Geuens, Emblem (BE); Luc Verberckt, Wilrijk (BE); Ivan Hoogmartens, Wilrijk (BE); Frank De Voeght, Heist o/d Berg (BE); Iris Vanwelkenhuysen, Sint-Truiden (BE)

(73) Assignee: AGFA Gevaert, Mortsel (BE)

( * ) Notice: Subject to any disclaimer, the term of this patent is extended or adjusted under 35 U.S.C. 154(b) by 0 days.

(21) Appl. No.: 11/204,690

(22) Filed: Aug. 16, 2005

(65) Prior Publication Data

US 2005/0287482 A1 Dec. 29, 2005

Related U.S. Application Data

(62) Division of application No. 10/306,254, filed on Nov. 27, 2002, now Pat. No. 6,962,773.

(60) Provisional application No. 60/349,510, filed on Jan. 18, 2002.

(30) Foreign Application Priority Data

Nov. 30, 2001 (EP) ..... 01000691

(51) Int. Cl.
*G03C 5/16* (2006.01)
*G03C 1/489* (2006.01)

(52) U.S. Cl. ..... 430/350; 430/530; 430/619; 430/620; 430/964; 430/965

(58) Field of Classification Search ..... 430/619, 430/350, 620, 965, 964, 530, 608, 604, 605
See application file for complete search history.

(56) References Cited

U.S. PATENT DOCUMENTS

| | | | | |
|---|---|---|---|---|
| 4,208,478 | A * | 6/1980 | Gardner et al. | 430/616 |
| 5,051,335 | A | 9/1991 | Kato | |
| 5,599,647 | A * | 2/1997 | Defieuw et al. | 430/200 |
| 6,036,889 | A | 3/2000 | Kydd | |

FOREIGN PATENT DOCUMENTS

| | | |
|---|---|---|
| EP | 0 696 515 A1 | 2/1996 |

* cited by examiner

*Primary Examiner*—Thorl Chea
(74) *Attorney, Agent, or Firm*—Leydig, Voit & Mayer, Ltd

(57) ABSTRACT

A black and white thermographic recording material comprising a thermosensitive element and a support, the thermosensitive element containing at least one substantially light-insensitive organic silver salt, a binder and optionally photosensitive silver halide, characterized in that the thermosensitive element further contains deliberately added metal nano-particles in a molar ratio with respect to the total molar concentration of the at least one substantially light-insensitive organic silver salt in the range of 0.05:1 to $10^{-6}$:1; and the use for the purpose of increasing the ratio of $D_{max}$ to the quantity of said substantially light-insensitive organic silver salts per unit area of the above-mentioned thermographic recording material.

15 Claims, No Drawings

THERMOGRAPHIC RECORDING MATERIAL WITH IMPROVED DEVELOPABILITY

The application claims the benefit of U.S. Provisional Application No. 60/349,510 filed Jan. 18, 2002, which is incorporated by reference.

FIELD OF THE INVENTION

The present invention relates to thermographic recording materials whose prints have improved archival properties.

BACKGROUND OF THE INVENTION

U.S. Pat. No. 6,036,889 discloses a conductive thick film composition comprising a mixture of: a metallo-organic decomposition (MOD) compound; a first metal powder with a particle thickness of about 1 μm in an amount of about 1 to about 10 times the amount of the MOD compound by weight; and, an organic liquid vehicle in an amount of about 0.4 to 1.5 times the MOD compound by eight. Furthermore, U.S. Pat. No. 6,036,869 discloses at col. 9, lines 28–32, that the vehicle used in the composition dissolves the MOD compound and suspends the metallic constituents of the mixture to provide inks and pastes that can be applied by screen printing, stencil printing, gravure printing or any other direct contact printing processes.

Thermal imaging or thermography is a recording process wherein images are generated by the use of thermal energy. In direct thermal thermography a visible image pattern is formed by image-wise heating of a recording material.

In 1982, J. W. Shepard stated in J. Appl. Photographic Engineering Vol. 8, pages 210–212 reported that the catalyst in the thermal development of photothermographic and thermographic materials based on organic silver salts was very small silver particles. In 1989, A. T. Ram, J. L. McCrea and R. Snell stated in J. Imaging Technology volume 15, pages 169–177 that photolytic silver acts as a catalyst in the reduction of silver carboxylates by reducing agents. In 1989, D. H. Klosterboer stated in Imaging Processes and Materials, Neblette's 8th Edition, Edited by J. Sturge, V. Walworth and A. Shepp, Van Nostrand pages 279–291 that silver reduction can occur in all reactions from the silver filament in an autocatalytic reaction.

U.S. Pat. No. 5,051,335 discloses a process for forming an image which comprises imagewise exposing a heat developable light-sensitive material comprising light-sensitive silver halide emulsion layers on a paper support, and thereafter heating the same to develop the image, wherein at least one subbing layer comprising a hydrophilic binder and at least one material capable of inhibiting fog selected from a light-insensitive silver halide, colloidal silver, an organic silver salt, activated carbon powder and a porous silicon dioxide powder is interposed between the undermost layer among said light-sensitive silver halide emulsion layers and said paper support, whereby fog is inhibited.

Furthermore, in 1991, D. A. Morgan stated in the Handbook of Imaging Science, Edited by A. R. Diamond, Marcel Dekker, pages 43–60 that dry silver reactions do not go to completion. Analysis of thermographic and photothermographic materials subsequent to thermal development confirmed that residual organic silver salt and residual reducing agent were still present in regions in which the maximum is possible image density with the materials had been attained.

Incomplete reduction of the organic silver salt present in maximum density regions is undesirable for two reasons: it represents ineffective use of the organic silver salt present and hence additional ingredient costs and it leads to unnecessary potential image density instability due to the potential for further reaction, thereby requiring a higher concentration of image density stabilizers than would otherwise be the case.

ASPECTS OF THE INVENTION

It is therefore an aspect of the present invention to provide substantially light-insensitive thermographic recording materials with an improved organic silver salt utilization i.e. an increased ratio of Dmax to quantity of substantially light-insensitive organic silver salts per unit area.

It is therefore a further aspect of the present invention to provide photothermographic recording materials with improved utilization in image formation of the organic silver salt present.

It is another aspect of the present invention to enhance the thermal developability of substantially light-insensitive thermographic recording materials.

Further aspects and advantages of the invention will become apparent from the description hereinafter.

SUMMARY OF THE INVENTION

One skilled in the art of photothermography knows that any silver nuclei present in the organic silver salts used in photothermographic recording materials have to be removed prior to the coating process to avoid image fogging. Furthermore, the presence of silver nuclei in the organic silver salts used in thermographic recording materials has to be avoided, particularly when such materials are coated from aqueous media. On the other hand U.S. Pat. No. 5,051,335 discloses the use of colloidal silver in a subbing layer of a photothermographic recording material to inhibit fog.

However, it has been found that deliberate introduction of 1 mole of silver nano-particles (4 nm) per mole of organic silver salt, e.g. as a silver sol or by reduction of the organic silver salt with a mild reducing agent such as thiourea dioxide or stannous salts, was found in the presence of a toning agent and an equi-equivalent concentration of reducing agent to inhibit completely the thermal development process. This is a possible explanation for the above-mentioned observation by Morgan that even for the maximum possible image density all the organic silver salt had not been reduced by the reducing agent in that it is believed that silver nuclei are formed during the thermal development process and it is conceivable that a critical local concentration of silver nuclei is attained, at which the thermal development process is inhibited, before all the organic silver salt present has been consumed.

On the other hand, it has been surprisingly found that upon repeating this experiment with a 100- to $10^6$-fold reduction in the molar ratio of silver nano-particles with respect to organic silver salt in the presence of toning agent and an equi-equivalent concentration of reducing agent an up to fivefold increase of Ag° XRD-intensity over the level attained in its absence was observed, thereby enabling a more effective utilization of the organic silver salt present and overcoming the inhibition otherwise observed.

Aspects of the present invention have been realized by a dispersion containing at least one substantially light-insensitive organic silver salt, a suspending medium and deliberately added metal nano-particles in a molar ratio with respect to the total molar concentration of said at least one substantially light-insensitive organic silver salt in the range of 0.05:1 to $10^{-6}$:1, wherein the substantially light-insensitive organic silver salt is substantially insoluble in the suspending medium.

Aspects of the present invention have further been realized by a process for preparing the above emulsion, comprising the steps of: (i) preparing a dispersion of a light-insensitive organic silver salt; (ii) preparing a dispersion of colloidal metal particles; (iii) mixing the dispersion of metal nano-particles of step (ii) with one or more dispersions of a light-insensitive organic silver salt.

Aspects of the present invention have also been realized by a process for preparing a substantially light-insensitive black and white thermographic recording material comprising a thermosensitive element and a support, the thermosensitive element containing at least one substantially light-insensitive organic silver salt and a binder, wherein the thermosensitive element further contains deliberately added metal nano-particles in a molar ratio with respect to the total molar concentration of the at least one substantially light-insensitive organic silver salt in the range of 0.05:1 to $10^{-6}$:1, comprising the steps of: (i) mixing the above-mentioned dispersion with a reducing agent and a toning agent; and (ii) coating the dispersion prepared in step (i) on a support.

Aspects of the present invention have also been realized by a process for preparing a black and white photothermographic recording material comprising a thermosensitive element and a support, the thermosensitive element containing at least one substantially light-insensitive organic silver salt, an organic reducing agent therefor in thermal working relationship therewith, a toning agent and a binder, wherein the thermosensitive element further contains deliberately added metal nano-particles in a molar ratio with respect to the total molar concentration of the at least one substantially light-insensitive organic silver salt in the range of 0.05:1 to $10^{-6}$:1, comprising the steps of: (i) mixing the above-disclosed dispersion additionally containing photosensitive silver halide with a reducing agent and a toning agent; and (ii) coating the dispersion prepared in step (i) on a support.

Aspects of the present invention have also been realized by a black and white thermographic recording material comprising a thermosensitive element and a support, the thermosensitive element containing at least one substantially light-insensitive organic silver salt and a binder, characterized in that the thermosensitive element further contains deliberately added metal nano-particles in a molar ratio with respect to the total molar concentration of the at least one substantially light-insensitive organic silver salt in the range of 0.05:1 to $10^{-6}$:1.

Aspects of the present invention have also been realized by a thermographic recording process comprising the steps of: (i) bringing an outermost layer of the above-mentioned thermographic recording material or produced as described above into proximity with a heat source; (ii) applying heat from the heat source imagewise to the thermographic recording material in a substantially water-free condition while maintaining proximity to the heat source to produce an image; and (iii) removing the thermographic recording material from the heat source.

Aspects of the present invention have also been realized by a photothermographic recording process comprising the steps of: (i) image-wise exposing to actinic light the above-mentioned photothermographic recording material wherein photosensitive silver halide is additionally contained in the thermosensitive element; (ii) bringing an outermost layer of the photothermographic recording material into proximity with a heat source; (iii) applying heat from the heat source uniformly to the photothermographic recording material in a substantially water-free condition while maintaining proximity to the heat source to produce an image; and (iv) removing the photothermographic recording material from the heat source.

Aspects of the present invention have also been realized by providing the use in a thermographic recording material comprising a thermosensitive element, the thermosensitive element containing at least one substantially light-insensitive organic silver salt, an organic reducing agent therefor in thermal working relationship therewith, a toning agent and a binder, of deliberately added metal nano-particles to the thermosensitive element in a molar ratio of the metal nano-particles with respect to the total molar concentration of the at least one substantially light-insensitive organic silver salt in the range of 0.05:1 to $10^{-6}$:1 for the purpose of increasing the ratio of Dmax to the total quantity of the at least one substantially light-insensitive organic silver salt per unit area of the thermographic recording material.

Preferred embodiments of the present invention are disclosed in the detailed description of the invention.

DETAILED DESCRIPTION OF THE INVENTION

Definitions

By substantially light-insensitive is meant not intentionally light sensitive.

The term thermographic recording material as used in disclosing the present invention includes both substantially light-insensitive thermographic recording materials and photothermographic recording materials, the latter additionally comprising photosensitive silver halide.

By metal nano-particles is meant metal particles in a colloidal state with a volume-averaged particle size of 100 nm or less as determined by light scattering, disc centrifuge or other techniques suitable for sub-micron high density particles freely dispersed in a liquid medium regardless of how the metal nano-particles were originally prepared. These metal nano-particles may substantially comprise a single metal or comprise one or more metals either uniformly distributed e.g. as an alloy or dispersion or non-uniformly distributed e.g. as a layered structure or a core-shell configuration.

By the term deliberately added metal nano-particles is meant either the addition of ex-situ prepared metal nano-particles or the deliberate preparation of metal nano-particles in-situ. The ex-situ and in-situ metal nano-particles can be deliberately added at any step in preparing the dispersion, according to the present invention, or at any time up to the coating of the thermosensitive element e.g. during the preparation of the substantially light-insensitive silver salt, subsequent to the preparation of the substantially light-insensitive silver salt and before the addition of other ingredients contained in the thermosensitive element to the coating dispersion, during the addition of other ingredients contained in the thermosensitive element to the coating dispersion or subsequent to the addition of other ingredients contained in the thermosensitive element to the coating dispersion.

The expression "equivalent" as referred to a reducing agent refers to the molecular weight divided by the number of silver ions a molecule thereof can reduce.

The term aqueous includes water and mixtures of water with one or more water miscible organic solvents in which at least 50% by volume is water.

Heating in a substantially water-free condition as used herein, means heating at a temperature of 80 to 250° C. The term substantially water-free condition means that the reaction system is approximately in equilibrium with water in the air, and water for inducing or promoting the reaction is not particularly or positively supplied from the exterior to the element. Such a condition is described in T. H. James, The Theory of the Photographic Process, Fourth Edition, Macmillan 1977, page 374.

Dispersion

Aspects of the present invention have been realized by a dispersion containing at least one substantially light-insensitive organic silver salt and deliberately added metal nano-particles in a molar ratio with respect to the total molar concentration of the at least one substantially light-insensitive organic silver salt in the range of 0.05:1 to $10^{-6}$:1.

According to a first embodiment of the dispersion, according to the present invention, the metal of said deliberately added metal nano-particles is selected from the group consisting of silver, gold and palladium or alloys thereof.

According to a second embodiment of the dispersion, according to the present invention, said dispersion further comprises photosensitive silver halide.

Thermographic Recording Material

Aspects of the present invention are realized with a black and white thermographic recording material comprising a thermosensitive element and a support, the thermosensitive element containing at least one substantially light-insensitive organic silver salt and a binder, characterized in that the thermosensitive element further contains deliberately added metal nano-particles in a molar ratio with respect to the total molar concentration of the at least one substantially light-insensitive organic silver salt in the range of 0.05:1 to $10^{-6}$:1.

According to a first embodiment of the black and white thermographic recording material, according to the present invention, the molar ratio of the deliberately added metal nano-particles in the thermosensitive element with respect to the total molar concentration of the at least one substantially light-insensitive organic silver salt is in the range of 0.02:1 to $2\times10^{-6}$:1.

According to a second embodiment of the black and white thermographic recording material, according to the present invention, the molar concentration of the deliberately added metal nano-particles in the thermosensitive element with respect to the total molar ratio of the at least one substantially light-insensitive organic silver salt is in the range of 0.005:1 to $5\times10^{-6}$:1.

According to a third embodiment of the black and white thermographic recording material, according to the present invention, the molar ratio of the deliberately added metal nano-particles in the thermosensitive element with respect to the total molar concentration of the at least one substantially light-insensitive organic silver salt is in the range of 0.002:1 to $10^{-5}$:1.

Metal Nano-Particles

The metal nano-particles incorporated into the dispersion, according to the present invention, and the thermosensitive elements of the thermographic and photothermographic recording materials, according to the present invention, are capable of catalyzing the reduction of organic silver salts to metallic silver.

The deliberately added colloidal metal nano-particles as used in the present invention can be either produced in situ or by dispersing sub-micron particles not produced in the liquid medium e.g. by decomposition, in a plasma, by laser ablation, by thermal evaporation, by electroexploded wire (EEW) or in a host material from which the particles have to be removed.

Metal nano-particles can be produced in situ by the reduction of metallic compounds in a liquid medium by reducing agents, by grinding in a liquid medium, by decomposition in a liquid medium, by electrolytic dispersion of metals immersed in a liquid medium, by discharge dispersion of metals immersed in a liquid medium, electrochemical techniques in an aqueous medium or by electrolysis of metal salts in a liquid medium. The stability of the dispersion is maintained by the negative charge on the metal particles and their consequent mutual repulsion. The negative charge is caused by the adsorption of anions. Ageing and the effects of electrolytes can be inhibited by adding protective agents.

The liquid medium can be aqueous, non-aqueous, water, a solvent, a mixture of solvents, a mixture of one or more water-miscible solvents with water or two immiscible liquids e.g. oil in water microemulsions.

Examples of suitable reducing agents for reducing metallic compounds are: hydrogen, hydrazine, hydrazine compounds, carbon monoxide, phosphorus, phosphine, phosphorous acid, phosphites, hypophosphites, alkali dithionites, phenols, p-hydroxyphenylglycine, aldehydes such as formaldehyde, formaldehyde in an alkaline medium, hydroquinone, alkenols, alkynols, dienols (e.g. ascorbic acid), ethylenediaminetetra-acetic acid (EDTA), triethanolamine in alkaline media, alkali borohydrides and alkali aluminium hydrides.

Suitable protective agents in the case of an aqueous medium are gelatin, starches, gum arabic, agar-agar, poly (vinyl alcohol), poly(acrylic acid), poly(vinyl pyrrolidone) polyethylene glycol, CARBOWAX™ 30M, poly(vinyl pyridine) and dispersion agents which adsorb on the surface of the metal nano-particles e.g. $(NaPO_3)_3$, (SURFINOL™ 465 (an acetylene glycol-series nonionic surfactant from Air products), ethoxylated alkyl phenols, a hydroxy acid salt containing a total of ≧3 groups of COO group(s) and OH group(s) and the number of COO group(s) is equal to or greater than that of OH groups e.g. trisodium citrate (as disclosed in JP 2001167647) and bis(naphthalene sulfonic acid) disodium salt as disclosed in RO 82-109289.

The preparation of colloidal silver nano-particles is described in "Gmelins Handbuch der anorganischen Chemie, Achte Auflage, 61 Ag, Band A3, Verlag Chemie, Weinheim (1971) pages 183–201, hereby incorporated by reference. Furthermore K. -S. Chou and C. -Y. Ren in Materials Chemistry and Physics, Volume 64, pages 241–246 published in 2000 disclosed the synthesis of nano-sized silver particles by a chemical reduction method by reducing silver nitrate with formaldehyde in an alkaline medium in the presence of poly(vinyl pyrrolidone) or poly (vinyl alcohol) as protective agent and G. Cardenas-Trivino, V. Vera L and C. Munoz in Materials Research Bulletin, volume 33, pages 645–653 published in 1998 disclosed the preparation of silver nano-particle colloids from non-aqueous solvents by chemical liquid deposition in which the metals were cocondensed at 77K with organic solvents to produce solvated metal atoms, which upon warming formed stable liquid colloids.

Thermosensitive Element

The thermosensitive element as used in the thermographic recording material, according to the present invention, is that element which contains all the ingredients which contribute to image formation. According to the present invention the thermosensitive element, contains a substantially light-insensitive organic silver salt, an organic reducing agent therefor in thermal working relationship therewith, a image tone stabilizer and a binder.

According to a fourth embodiment of the black and white thermographic recording material, according to the present invention, the thermosensitive element further comprises photosensitive silver halide.

The element may comprise a layer system in which the above-mentioned ingredients may be dispersed in different layers, with the proviso that the substantially light-insensitive organic silver salt is in reactive association with the reducing agent i.e. during the thermal development process the reducing agent must be present in such a way that it is able to diffuse to the particles of substantially light-insensitive organic silver salt so that reduction to silver can occur.

Organic Silver Salt

According to a fifth embodiment of the black and white thermographic recording material, according to the present invention, the at least one substantially light-insensitive organic silver salt is a substantially light-insensitive silver salt of an organic carboxylic acid.

According to a sixth embodiment of the black and white thermographic recording material, according to the present invention, the at least one substantially light-insensitive organic silver salt is a silver salt of an aliphatic carboxylic acid known as a fatty acid.

According to a seventh embodiment of the black and white thermographic recording material, according to the present invention, the at least one substantially light-insensitive organic silver salt is an aliphatic carboxylic acid wherein the aliphatic carbon chain has at least 12 C-atoms, e.g. silver laurate, silver palmitate, silver stearate, silver hydroxystearate, silver oleate and silver behenate, which silver salts are also called "silver soaps".

Other silver salts of an organic carboxylic acid as described in GB-P 1,439,478, e.g. silver benzoate, may likewise be used to produce a thermally developable silver image.

According to an eighth embodiment of the black and white thermographic recording material, according to the present invention, the at least one substantially light-insensitive organic silver salt is a combination of different silver salt of organic carboxylic acids, as disclosed in EP-A 964 300 herein incorporated by reference.

Organic silver salts may be dispersed by standard dispersion techniques e.g. using ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and a more finely ground dispersions of organic silver salts.

Reducing Agents

According to an ninth embodiment of the black and white thermographic recording material, according to the present invention, the reducing agent is an organic compound containing at least one active hydrogen atom linked to O, N or C, such as is the case with, aromatic di- and tri-hydroxy compounds. 1,2-dihydroxybenzene derivatives, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxybenzoic acid esters such as ethyl 3,4-dihydroxybenzoate and n-butyl 3,4-dihydroxybenzoate are preferred, with those described in EP-B 692 733 and EP-A 903 625 being particularly preferred e.g. 3,4-dihydroxy-benzophenone and 3,4-dihydroxy-benzonitrile.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Binder of the Thermosensitive Element

The film-forming binder of the thermosensitive element may be all kinds of natural, modified natural or synthetic resins or mixtures of such resins, in which the at least one organic silver salt can be dispersed homogeneously either in aqueous or solvent media: e.g. cellulose derivatives, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylates, polymethacrylates, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders, polysaccharides and water-soluble cellulose derivatives. A preferred water-soluble binder for use in the thermographic recording materials of the present invention is gelatine.

The binder to organic silver salt weight ratio is preferably in the range of 0.2 to 7, and the thickness of the thermosensitive element is preferably in the range of 5 to 50 μm. Binders are preferred which do not contain additives, such as certain antioxidants (e.g. 2,6-di-tert-butyl-4-methylphenol), or impurities which adversely affect the thermographic properties of the thermographic recording materials in which they are used.

Toning Agent

According to a tenth embodiment of the black and white thermographic recording material, according to the present invention, the thermosensitive element contains a toning agent, which enables a neutral black image tone to be obtained in the higher densities and neutral grey in the lower densities.

According to an eleventh embodiment of the black and white thermographic recording material, according to the present invention, the thermosensitive element further contains a toning agent selected from the group consisting of phthalimides, phthalazinones, benzoxazine diones and naphthoxazine diones e.g. phthalimides and phthalazinones within the scope of the general formulae described in U.S. Pat. No. 4,082,901; the toning agents described in U.S. Pat. Nos. 3,074,809, 3,446,648 and 3,844,797; and the heterocyclic toner compounds of the benzoxazine dione or naphthoxazine dione type as disclosed in GB 1,439,478, U.S. Pat. No. 3,951,660 and U.S. Pat. No. 5,599,647, herein incorporated by reference. Particularly preferred toning agents for substantially light-insensitive thermographic recording materials, according to the present invention, are phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

Antifoggants

According to a twelfth embodiment of the black and white thermographic recording material, according to the present invention, the thermographic recording material further contains an antifoggant to obtain improved shelf-life and reduced fogging.

According to a thirteenth embodiment of the black and white thermographic recording material, according to the present invention, the thermographic recording material further contains an antifoggant selected from the group consisting of benzotriazole, substituted benzotriazoles, tetrazoles, mercaptotetrazoles and aromatic polycarboxylic acid such as ortho-phthalic acid, 3-nitro-phthalic acid, tetrachlorophthalic acid, mellitic acid, pyromellitic acid and trimellitic acid and anhydrides thereof.

Polycarboxylic Acids and Anhydrides Thereof

According to an fourteenth embodiment of the black and white thermographic recording material, according to the present invention, the thermosensitive element further contains at least one polycarboxylic acid and/or anhydride thereof in a molar percentage of at least 15 with respect to all the organic silver salt(s) present and in thermal working relationship therewith. The polycarboxylic acid may be aliphatic (saturated as well as unsaturated aliphatic and also cycloaliphatic) or an aromatic polycarboxylic acid, may be substituted and may be used in anhydride form or partially esterified on the condition that at least two free carboxylic acids remain or are available in the heat recording step.

Photosensitive Silver Halide

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., or a combination thereof. The details of these procedures are described in T. H. James, "The Theory of the Photographic Process", Fourth Edition, Macmillan Publishing Co. Inc., New York (1977), Chapter 5, pages 149 to 169.

The grain size of the silver halide particles can be determined by the Moeller Teller method in the sample containing silver halide particles is sedimented upon a filter paper, which is submerged in electrolyte together with a negative platinum needle-shaped electrode and a reference electrode. The silver halide particles on the filter paper are slowly scanned individually with the needle-shaped electrode, whereupon the silver halide grains are individually electrochemically reduced at the cathode. This electrochemical reduction is accompanied by a current pulse, which is registered as a function of time and integrated to give the charge transfer Q for the electrochemical reduction of the silver halide particle, which is proportional to its volume. From their volume the equivalent circular grain diameter of each grain can be determined and therefrom the average particle size and size distribution.

Surfactants and Dispersion Agents

According to a fifteenth embodiment of the black and white thermographic recording material, according to the present invention, the thermographic recording material further contains at least one surfactant or dispersant to aid the dispersion of ingredients or reactants which are insoluble in the particular dispersion medium.

According to a sixteenth embodiment of the black and white thermographic recording material, according to the present invention, the thermographic recording material further contains one of more surfactants, which may be anionic, non-ionic or cationic.

Other Additives

The recording material may contain in addition to the ingredients mentioned above other additives such as antistatic agents, e.g. non-ionic antistatic agents including a fluorocarbon group as e.g. in $F_3C(CF_2)_6CONH(CH_2CH_2O)$—H, silicone oil, e.g. BAYSILON™ MA (from BAYER AG, GERMANY).

Support

The support for the thermosensitive element according to the present invention may be transparent or translucent and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thereon coated thermosensitive element. It may be pigmented with a blue pigment as so-called blue-base. One or more backing layers may be provided to control physical properties such as curl and static.

Protective Layer

According to a seventeenth embodiment of the black and white thermographic recording material, according to the present invention, the thermosensitive element is provided with a protective layer to avoid local deformation of the thermosensitive element and to improve resistance against abrasion.

According to an eighteenth embodiment of the black and white thermographic recording material, according to the present invention, the thermosensitive element is provided with a protective layer comprising a binder, which may be solvent-soluble, solvent-dispersible, water-soluble or water-dispersible. Among the solvent-soluble binders polycarbonates as described in EP-A 614 769 are particularly preferred. However, water-soluble or water-dispersible binders are preferred for the protective layer, as coating can be performed from an aqueous composition and mixing of the protective layer with the immediate underlayer can be avoided by using a solvent-soluble or solvent-dispersible binder in the immediate underlayer. The protective layer according to the present invention may be crosslinked. Crosslinking can be achieved by using crosslinking agents such as described in WO 95/12495. Solid or liquid lubricants or combinations thereof are suitable for improving the slip characteristics of the thermographic recording materials according to the present invention. Preferred solid lubricants are thermomeltable particles such as those described in WO 94/11199. The protective layer of the thermographic recording material according to the present invention may comprise a matting agent. Preferred matting agents are described in WO 94/11198, e.g. talc particles, and optionally protrude from the protective layer.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Printing

Thermographic printing is carried out by the image-wise application of heat either in analogue fashion by direct exposure through an image of by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

According to a first embodiment of the thermographic recording process, according to the present invention, the heat source is a thin film thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 11.0 ms, the pressure contact of the thermal printhead with the recording material being to ensure a good transfer of heat to ensure a good transfer of heat being e.g. 200–1000 g/linear cm i.e. with a contact zone (nip) of 200 to 300 μm a pressure of 5000 to 50,000 g/cm$^2$.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Photothermographic Printing

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the aspect itself or an image therefrom with appropriate illumination e.g. with UV, visible or IR light. For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

INDUSTRIAL APPLICATION

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated. The ingredients used in the invention and comparative examples, are:

Hystrene® 9022 is a mixture of 0 to 1% by weight palmitic acid (typically 0.2%), 5 to 9% by weight of stearic acid (typically 7.0%), 36 to 41% by weight of arichidic acid (typically 37.3%) and 50 to 55% by weight of behenic acid (typically 54.2%) with a concentration of arichidic and behenic acid of at least 88.0% by weight supplied by CKWitco Corporation;

organic silver salts:
AgB=silver behenate;
the surfactants:
Surfactant Nr. 1=MARLON A-396, a sodium alkyl-phenyl-sulfonate from Hüls;
Surfactant Nr. 1=MARLON™ A-365, supplied as a 65% concentrate of a sodium alkyl-phenylsulfonate by HÜLS;
Surfactant Nr. 2=MARLON™ AS3, supplied as a 98% concentrate of an alkylphenylsulfonic acid by HÜLS
Surfactant Nr. 3=ammonium salt of alkylphenylsulfonic acid
silver nano-particle dispersions:
AG01=a 0.01106 mol/L aqueous dispersion of 4 nm silver particles with 0.1% by weight of poly(vinyl alcohol) as dispersing agent;
AG02=a 0.0145 mol/L aqueous dispersion of 10 nm silver particles with 0.1% by weight poly(acrylic acid) as dispersing agent;
the reducing agents:
R01=ethyl 3,4-dihydroxybenzoate;
R02=3,4-dihydroxybenzonitrile;
R03=n-propyl gallate;
the binders:
K17881=type 17881, a gelatin with low potassium ion, sodium ion and chloride-ion concentrations from AGFA-GEVAERT GELATINEFABRIEK vorm. KOEPFF & SÖHNE;
R16875=type 16875, a phthaloyl-gelatin from Rousselot;
LATEX01=a copolymer consisting of 54.25 wt. % styrene, 43.25 wt. % butyl acrylate and 2.5 wt. % potassium salt of N-[(4'-sulfobenzamido)-oxo-decyl]-methacrylamide
BL5-HPZ=S-LEC™ BL5-HPZ from Sekisui Chemical Co. Ltd.
BL16=Pioloform™ BL16 a polyvinyl butyral from Wacker
the toning agents:
T01=benzo[e][1,3]oxazine-2,4-dione
T02=7-(ethylcarbonato)-benzo[e][1,3]oxazine-2,4-dione;
T03=phthalazinone;
the stabilizers:
S01=1-phenyl-5-mercapto-tetrazole;
S02=tetrachlorophthalic acid anhydride;
S03=1-(3-decanoyl-phenyl)-5-mercapto-tetrazole;
aldiox=aminoiminomethane sulfinic acid [HN═($NH_2$)C—$SO_2H$];
oil=BAYSILON®, a silicone oil from BAYER;
sodium p-toluene thiosulfonate solution=aqueous solution containing 0.984% by weight of sodium p-toluene thiosulfonate and 0.656% by weight of sodium p-toluene sulfinate.

COMPARATIVE EXAMPLES 1 TO 10 AND INVENTION EXAMPLES 1 AND 2

Preparation of the Silver Behenate Dispersion in an Aqueous Medium in the Absence of Organic Solvent Using the Single Jet Process Disclosed in EP-A 848 286

The type I aqueous dispersion of organic silver salt used in INVENTION EXAMPLES 1 to 10 and COMPARATIVE EXAMPLE 1 and 2 was produced as follows:

i) dispersing 136.2 g (0.4M) behenic acid with stirring at 310 rpm with a 80 mm diameter typhoon stirrer in a 200 mm in diameter vessel at 80° C. in a quantity of 0.549 L of a 10% solution of Surfactant nr 1 and 662 g of deionized water at a temperature of 80° C.;

ii) then adding 0.188 L of a 2M aqueous solution of sodium hydroxide with stirring at 310 rpm with a 80 mm diameter typhoon stirrer to the 200 mm in diameter vessel at 80° C. over a period of 10 minutes to produce a clear solution substantially containing sodium behenate;

iii) then adding a 0.360 L of a 1M aqueous solution of silver nitrate with stirring at 310 rpm with a 80 mm diameter typhoon stirrer to the 200 mm in diameter vessel at a temperature of 80° C. over a period of 4.5 minutes to convert the sodium behenate completely into silver behenate.

The aqueous silver behenate dispersion obtained contained 8.15% by weight of silver behenate and 2.78% by weight of Surfactant Nr. 1 and was subsequently desalted and concentrated by ultrafiltration to an aqueous dispersion containing 23.1% by weight of silver behenate and 1.48% by weight of Surfactant Nr. 3, the counterion of the surfactant being changed by addition of ammonium nitrate and removal of sodium nitrate during the ultrafiltration process.

Silver Nano-Particle Dispersion

AG01, an aqueous dispersion containing 0.01106 mol/L of 4 nm silver particles stabilized with 1 g/L by weight of poly(vinyl alcohol) and having a pH of 4.26 at 15° C., was produced by mixing a mixture of 6.8 mL of a 2.94M aqueous solution of silver nitrate (0.020 moles) with 500 mL of a 0.1% by weight of poly(vinyl alcohol) with a solution of 0.6 g of potassium borohydride ($KBH_4$) in 500 mL of a 0.1% by weight of poly(vinyl alcohol) and 800 mL of a 0.1% by weight of poly(vinyl alcohol).

AG02, an aqueous dispersion containing 0.0145 mol/L of 10 nm silver particles stabilized with 0.99 g/L of poly (acrylic acid) and having a pH of 8.14 at 25° C., was prepared by gradually adding 15 L of a 0.1236M aqueous solution of potassium borohydride ($KBH_4$) (100 g) to 35.45 L of a 0.0206M aqueous solution of $AgNO_3$ (0.732 moles) containing 1.41 g/L of polyacrylic acid.

Preparation of Samples with Reducing Agent R01

The samples with reducing agent R01 used in the model experiments of COMPARATIVE EXAMPLE 1, 2 and 5 to 8 and INVENTION EXAMPLE 1 were prepared by adding to 21.89 g of silver behenate dispersion (containing 5.057 g (0.0113 moles) silver behenate): optionally 1 g (0.0055 moles) of R01 as a solution in 2 g of ethanol and 1 g of the ingredients and 0.8839 g (0.00352 moles) of T02 as a dispersion also containing 0.486 g of K17598 and 3.50 g of deionized water and optionally the required quantity of AG01 (1021.9 mL for an AgBeh:Ag° ratio of 1:1, 102.2 mL for an AgBeh:Ag° ratio of 1:0.1 and 10.22 mL for an AgBeh:Ag° ratio of 1:0.01) or AG02 (807 mL for an AgBeh:Ag° ratio of 1:1, 80.7 mL for an AgBeh:Ag° ratio of 1:0.1 and 8.07 mL for an AgBeh:Ag° ratio of 1:0.01) and then diluted to 57.0 g with deionized water where possible. After addition of the ingredients to the type I organic silver salt dispersion, the dispersion was mixed thoroughly to obtain a dispersion which remained homogeneous sufficiently long to enable a 20 μL sample to be taken for deposition in the platinum sample holder of the Philips X'Pert XRD apparatus in which the XRD measurements were carried out. All samples contained 0.49 moles of R01 per mole silver behenate and the moles of toning agent T02 and of silver particles per mole silver behenate, if present, are given in Table 2.

Model Experiments

The model experiments of COMPARATIVE EXAMPLES 1 to 10 and INVENTION EXAMPLES 1 and 2 were carried out by applying 20 μL of the corresponding dispersions to the platinum sample holder in a Philips X'Pert XRD apparatus with a CuKα X-ray source taking an XRD spectrum at 25° C., heating from 25° C. to 100° C. and then taking an XRD spectrum at 10° C. intervals in the 2θ-range: 5–55° in a continuous scan taking 5 minutes while the sample is heated from 100° C. to 200° C. at 20° C./min.

A relative measure of the silver behenate present before reduction began, IAgB, was obtained by integrating the peak intensities of the silver behenate 20 peaks at 5.96°, 7.47°, 8.97°, 10.47°, 12.03° and 13.53°. This XRD-spectrum was obtained at 100° C. to avoid any influence of residual water on the spectrum. The XRD intensity of the XRD 2θ-peak at 38.1° due to the Ag° obtained at 200° C., IAg°, was taken as a relative measure of the quantity of silver produced during the reduction process. Allowance was made for variation in the quantity of silver behenate deposited as a result of different silver behenate concentrations in the 20 μL of dispersion deposited in the sample holder, thereby rendering the IAg° values directly comparable with one another regardless of the amount of silver behenate deposited, by normalizing IAg° to a particular IAgB value i.e. IAg° (norm)=[IAg° (measured)×IAgB (standard)]/IAgB (measured).

Surprisingly sample size resulting from the dilution of the silver behenate had an effect on the thermal development process. For example COMPARATIVE EXAMPLES 1 and 2 and 3 and 4 only differed in dilution, but a 17.9-fold dilution with water result in a 25% reduction in silver particle yield IAg°(norm) at 200° C. in the case of R01 with T02 and 64% in the case of R02 with T01, see Table 1. The reason for this effect is unknown, but could be dependent upon the difference in the total quantity of ingredients deposited or due to different pH's as a result of the sample preparation.

TABLE 1

| Example | Moles with respect to 1 mole AgB type I | | | | | | IAg° (norm) in |
|---|---|---|---|---|---|---|---|
| | R01 | R02 | T01 | T02 | AG01 | AG02 | cps at 200° C. |
| Comp 1 | 0.49 | — | — | 0.31 | — | — | 1551 |
| Comp 2 | 0.49 | — | — | 0.31 | water | — | 1159 |
| Comp 3 | — | 0.50 | 0.075 | — | — | — | 3585 |
| Comp 4 | — | 0.50 | 0.075 | — | water | — | 1285 |

The IAg° (norm) values obtained in experiments with reducing agent R01 are given in Table 2.

TABLE 2

| Example | moles/mole AgB type 01 | | | | |
|---|---|---|---|---|---|
| | R01 | T02 | Ag°/4 nm (PVA) | Ag° (10 nm) (PAA) | IAg° (norm) In cps |
| Comp 5 | 0.49 | — | — | — | 2281 |
| Comp 6 | 0.49 | — | 0.1 | — | 536 |
| Comp 7 | 0.49 | — | — | 0.1 | 1062 |
| Comp 1 | 0.49 | 0.31 | — | — | 1551 |

TABLE 2-continued

| Example | moles/mole AgB type 01 | | | | |
|---|---|---|---|---|---|
| | R01 | T02 | Ag°/4 nm (PVA) | Ag° (10 nm) (PAA) | IAg° (norm) In cps |
| Comp 2 | 0.49 | 0.31 | water | — | 1159 |
| Comp 8 | 0.49 | 0.31 | 0.1 | — | 1175 |
| Inv 1 | 0.49 | 0.31 | 0.01 | — | 4919 |

It is clear from the results in Table 2 that in the presence of reducing agent R01 the presence of 0.1 moles of added 4 nm silver particles of AG01 or 0.1 moles of added 10 nm silver particles of AG03 per mole silver behenate strongly decreased the yield of silver particles over that obtained in the absence of added silver particles. However, the decrease in silver particle reduction was significantly smaller in the case of 10 nm silver particles.

This effect can be rationalized by considering the area of silver behenate surface occupied per silver particle assuming that all the added silver particles were adsorbed. Assuming silver behenate particles 3 μm long with a rectangular profile of 0.1 μm×0.05 μm and assuming that all silver particles added are to be found on the surface of the silver behenate particles, the surface area/4 nm silver particle for a 0.1:1 molar ratio of Ag° to AgB would be 677 $nm^2$ whereas the surface area/10 nm silver particle would be 10,567 $nm^2$. Hence the effect can be rationalized on the basis of silver particle stabilization of the silver behenate will be much greater in the case of 4 nm silver particles than in the case of 10 nm silver particles.

The additional presence of the toning agent T02 reduced the yield of silver particles in the presence of reducing agent R01. However, addition of 4 nm silver particles of Ag01 in a 0.1:1 molar ratio of Ag° to AgB, resulted in an absolute increase in silver particle yield compared with that in the absence of the toning agent T02 to a level marginally below that achieved in the absence of added 4 nm silver particles. Therefore, the addition of toning agent T02 largely nullified the negative effect of adding a 0.1:1 molar ratio of 4 nm Ag° to AgB.

Addition of even smaller molar quantities of 4 nm Ag° with respect to AgB in the presence of reducing agent R01 and toning agent T02 surprisingly resulted in an increase in silver particle yield above that in the absence of silver particles with or without toning agent T02. This indicated that the addition of smaller molar quantities of 4 nm silver particles with respect to AgB than 0.1 promoted the production of silver particles. However, such effects are only practically useful at molar ratios of silver nanoparticles with respect to AgB at or below 0.05, due to the prohibitive grey colour obtained at higher concentrations.

Preparation of Samples with Reducing Agent R02

The samples with reducing agent R02 used in the model experiments of COMPARATIVE EXAMPLE 3, 4, 9 and 10 and INVENTION EXAMPLES 2 were prepared by adding to 21.27 g of silver behenate dispersion (containing 4.9134 g (0.0110 moles) silver behenate): optionally 0.743 g (0.0055 moles) of R02 as a solution in 0.970 g of ethanol and 1.058 g of water whose pH was adjusted to 5.2 with ammonium hydroxide and 0.1345 g (0.0008244 moles) of T01 as a dispersion also containing 0.0740 g of K17881 and 0.4725 g of deionized water and optionally the required quantity of AG01 (99.49 mL for an AgBeh:Ag° ratio of 1:1, 9.95 mL for an AgBeh:Ag° ratio of 1:0.1 and 0.995 mL for an AgBeh:Ag° ratio of 1:0.01) or AG02 (78.57 mL for an AgBeh:Ag° ratio of 1:1, 7.857 mL for an AgBeh:Ag° ratio of 1:0.1 and 0.786 mL for an AgBeh:Ag° ratio of 1:0.01) and then diluted to 57.0 g with deionized water where possible. After addition of the ingredients to the type I organic silver salt dispersion, the dispersion was mixed thoroughly to obtain a dispersion which remained homogeneous sufficiently long to enable a 20 μL sample to be taken for deposition in the platinum sample holder of the Philips X'Pert XRD apparatus in which the XRD measurements were carried out. All samples contained 0.50 moles of R02 per mole silver behenate and the moles of the toning agent T01 and silver particles per mole silver behenate, if present, are given in Table 3. The IAg° (norm) values obtained in experiments with reducing agent R02 are given in Table 3.

It is clear from the results in Table 3 that in the presence of reducing agent R02 and toning agent T01 that the presence of 1 or 0.1 moles of added silver nano-particles of AG01 or AG02 per mole silver behenate strongly decreased the yield of silver particles over that obtained in the absence of added silver particles.

Addition of even smaller molar quantities of 4 nm Ag° with respect to AgB in the presence of reducing agent R02 and toning agent T01 surprisingly resulted in an increase in silver particle yield above that in the absence of silver particles with toning agent T01. This indicated that the addition of molar ratios of 4 nm silver particles with respect to AgB of less than 0.1 promoted the production of silver particles. However, such effects are only practically useful at molar ratios of silver nano-particles with respect to AgB at or below 0.05, due to the prohibitive grey colour obtained at higher concentrations.

TABLE 3

| | moles/mole AgB type 01 | | | | |
|---|---|---|---|---|---|
| Example | R02 | T01 | Ag°/4 nm (PVA) | Ag° (10 nm) (PAA) | IAg° (norm) in cps |
| Comp 3 | 0.50 | 0.075 | — | — | 3585 |
| Comp 4 | 0.50 | 0.075 | water | — | 1285 |
| Comp 9 | 0.50 | 0.075 | 1.0 | — | 285 |
| Inv 2 | 0.50 | 0.075 | 0.01 | — | 6252 |
| Comp 10 | 0.50 | 0.075 | — | 0.1 | 1407 |

COMPARATIVE EXAMPLES 11 TO 13 AND INVENTION EXAMPLES 3 TO 10

Preparation of the Type II Organic Silver Salt Dispersion

The organic silver salt type II was prepared by dissolving 180 moles of behenic acid in 2-butanone at 60° C. with vigorous stirring followed by adding demineralized water while maintaining the reactor at a temperature of between 56 and 60° C., converting the behenic acid into sodium behenate, to produce a concentration 0.248 M in sodium behenate by adding an aqueous solution of sodium hydroxide with vigorous stirring while maintaining the temperature of the reactor at a temperature between 56 and 60° C. and finally converting the 0.248 M solution of sodium behenate into a silver behenate dispersion by adding 180 moles of silver nitrate as a 0.4 M aqueous solution over a period of 240 minutes with vigorous stirring while maintaining the reactor temperature at 65° C. The final concentration of 2-butanone in the dispersion was 23% by weight. The silver behenate was then filtered off and dried in the dark.

The dispersion used in preparing the samples used in COMPARATIVE EXAMPLES 11 to 13 and INVENTION EXAMPLES 3 to 10 was obtained by first preparing a predispersion of 56.5 g of the dried silver behenate powder in a solution of 8.36 g of PVB in 72.6 g of 2-butanone by stirring for 2 minutes in a Dissolver™. This predispersion was then ground for 4 minutes in a pearl mill and just before the end of the 4 minutes a solution of 8.36 g of PVB in 72.6 g of 2-butanone was added. Finally a solution of 27.85 g of PVB in 242.3 g of 2-butanone was added to produce the type II organic silver salt dispersion of silver behenate in 2-butanone containing 11.18% by weight of silver behenate and 8.82% by weight of poly(vinyl butyral)(BL5-HPZ) used preparing the samples used in COMPARATIVE EXAMPLES 11 to 13 and INVENTION EXAMPLES 3 to 10.

Sample Preparation

The samples used in COMPARATIVE EXAMPLES 11 to 13 and INVENTION EXAMPLES 3 to 10 were prepared by adding the ingredients to silver behenate dispersion type II in quantities to produce the molar ratios with respect to silver behenate given in Table 3. For example in the case of samples with a 0.01:1 molar ratio of silver nano-particles to silver behenate, to 5 g of the type II organic silver salt dispersion containing $1.25\times10^{-3}$ moles of silver behenate was added 0.9 mL of the above-mentioned silver nano-particle dispersion containing $1.26\times10^{-5}$ moles diluted with 2 mL MEK and 2 mL ethanol, 114 mg ($6.25\times10^{-4}$ moles) of reducing agent R01 and 41 mg ($2.5\times10^{-4}$ moles) of toning agent T01 in powder form. In the case of the COMPARATIVE EXAMPLES without added silver nano-particles, the 0.9 mL of silver nano-particle dispersion was replaced by 0.9 mL of 2-butanone. The resulting dispersions were mixed thoroughly to produce a homogeneous dispersion, which remained homogeneous long enough for a representative 40 μL sample to be taken for deposition in the platinum sample holder of the Philips X'Pert XRD apparatus used for the XRD measurements.

Model Experiments

The model experiments of INVENTION EXAMPLES 3 to 10 and COMPARATIVE EXAMPLES 11 to 13 were carried as described for INVENTION EXAMPLES 1 and 2 and COMPARATIVE EXAMPLES 1 to 10. The results are summarized in Table 4.

It is clear from the results in Table 4 that even in the absence of reducing agent the presence of 0.01 moles of deliberately added 10 nm silver particles of AG02 with respect to AgB strongly increased the yield of silver particles over that obtained in the absence of deliberately added silver particles.

Furthermore, the presence of reducing agent 01 resulted in a higher silver particle yield and moreover, consistent with the results of the previous examples, the presence of a 0.01 molar ratio of deliberately added 10 nm silver particles of AG02 with respect to AgB strongly increased the yield of silver particles over that obtained in the absence of deliberately added silver particles.

Addition of toning agent T01 in the absence of added silver nano-particles resulted in a decrease in silver particle yield, but consistent with the above experiments, in the presence of a 0.01:1 molar ratio of deliberately added 10 nm silver particles with respect AgB in addition to toning agent T01 resulted in an increase in silver particle yield above that observed in the absence of added silver nano-particles in the presence or absence of the toning agent T01. Furthermore, the yield of silver nano-particles increased as the quantity of added silver nano-particles decreased down to a 0.00133:1 molar ratio of 10 nm silver particles with respect to AgB. Even at a molar ratio of 0.001:1 of added 10 nm silver particles with respect to AgB, the silver particle yield was substantially higher than that observed at a molar ratio of 0.01:1 of deliberately added 10 nm silver particles with respect to AgB.

TABLE 4

| | moles/mole type II AgB dispersed in PVB | | | IAg° (norm) in cps | % increase in IAg° |
|---|---|---|---|---|---|
| Example | R01 | T01 | AG02 | at 200° C. | (norm) |
| Comp 11 | — | — | solvent | 986 | — |
| Inv 3 | — | — | 0.01 | 1296 | 31 |
| Comp 12 | 0.50 | — | solvent | 2432 | — |
| Inv 4 | 0.50 | — | 0.01 | 3236 | 33 |
| Comp 13 | 0.50 | 0.20 | solvent | 1900 | — |
| Inv 5 | 0.50 | 0.20 | 0.01 | 3505 | 84 |
| Inv 6 | 0.50 | 0.20 | 0.005 | 4390 | 131 |
| Inv 7 | 0.50 | 0.20 | 0.002 | 5018 | 164 |
| Inv 8 | 0.50 | 0.20 | 0.00133 | 5642 | 197 |
| Inv 9 | 0.50 | 0.20 | 0.00111 | 4246 | 123 |
| Inv 10 | 0.50 | 0.20 | 0.001 | 4851 | 155 |

COMPARATIVE EXAMPLE 14 AND INVENTION EXAMPLES 11 TO 15

Preparation of Type III Organic Silver Salt Dispersions

The organic silver salt dispersion was produced as follows: 25 kg (73.5M) behenic acid was dispersed with stirring at 80° C. in 100 L of a 10% solution of Surfactant Nr. 1 per g behenic acid made up to 250 L with deionized water at a temperature of 80° C.; then 36.75 L of a 2M aqueous solution of sodium hydroxide was added over a period of 10 to 20 minutes to give a clear solution substantially containing sodium behenate; then 25 L of a 2.94M aqueous solution of silver nitrate was added with stirring at a rate of 0.163 moles/moles silver behenate-min to convert the sodium behenate completely into silver behenate; and finally ultrafiltration was carried out with a 500000 MW polysulfone cartridge filter at room temperature to concentrate the resulting silver behenate dispersion while adding ammonium nitrate to convert Surfactant Nr 1 into its ammonium salt, the final AgBeh-concentration was 20.4% with 0.062 g of ammonium alkyl-phenylsulfonate/g AgBeh, the residual conductivity was 11.0 mS/cm.

Preparation of Thermographic Recording Materials

The coating dispersion for the thermosensitive element was produced by first allowing 3.443 g of K17881 to swell in 16.191 g of deionized water over a period of 30 minutes. 2.80 g of a first aqueous toning agent dispersion containing 19.75% of T02 and 10.84% of K17881 and 0.85 g of a second toning agent dispersion containing 18.84% of T03 and 8.29% of R16875 were then added and the resulting dispersion heated with stirring up to 50° C. 2 g of the above-mentioned dispersion of silver behenate were then added and after 10 minutes stirring a further 22.2 g of the same silver behenate dispersion were added and the resulting dispersion stirred for a further 10 minutes before 4.394 g of a 25.28% dispersion of LATEX01 was added. After a further 10 minutes stirring 2.222 g of 5.9% polyitaconic acid in water was added and after a further 10 minutes stirring, the resulting dispersion was cooled to 36° C. The quantities of ingredients and water given in Table 5 were added and the dispersion stirred for a further 15 minutes.

Shortly before coating 3 g of an aqueous ethanol solution containing 3.33% of R01, 17.34% of R02 and 9.8% of S01 and 3 g of deionized water were added with stirring.

This coating dispersion at a temperature of 36° C. was then doctor-blade coated onto the non-backing layer side of a subbed 168 μm thick blue-pigmented polyethylene terephthalate support to respectively) to a wet coating weight of 78 g/m$^2$ and before drying was overcoated with 11 g/m$^2$ of an aqueous solution with 1.8% by of 1,1-bis(vinylsulfono) methane and 0.9091% by weight of ant Nr. 1. Drying produced the thermosensitive elements of COMPARATIVE EXAMPLE 14 and INVENTION EXAMPLES 11 to 15.

TABLE 5

| | | added | p-toluene thiosulfonic | quantities added | | |
|---|---|---|---|---|---|---|
| | AgB [g/m$^2$] | 10 nm Ag° [mol/mol AgB] | acid [mol % vs. AgB] | deionized water [g] | AG02 [g] | sodium p-toluene thiosulfonate solution [g] |
| Comparative example nr | | | | | | |
| 14 | 4.68 | 0 | 0 | 18 | — | — |
| Invention example nr | | | | | | |
| 11 | 4.89 | 0.001 | 0 | 17.214 | 0.786 | — |
| 12 | 4.65 | 0.01 | 0 | 10.14 | 7.86 | — |
| 13 | 4.94 | 0.01 | 0 | 10.14 | 7.86 | — |
| 14 | 5.02 | 0.01 | 1 | 7.79 | 7.86 | 2.35 |
| 15 | 4.84 | 0.01 | 2 | 5.44 | 7.86 | 4.7 |

Thermographic Printing

During the thermographic printing of the substantially light-insensitive thermographic recording materials of COMPARATIVE EXAMPLE 14 and INVENTION EXAMPLES 11 to 15, the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The DRYSTAR® 2000 printer from AGFA-GEVAERT was equipped with a thin film thermal head with a resolution of 300 dpi and was operated with a line time of 11.8 ms (the line time being the time needed for printing one line). During this line time the print head received constant power. The printing power was 90 mW and the thermal head resistors were time-modulated to produce different image densities.

The maximum densities of the images ($D_{max}$) measured through a visible filter with a MACBETH™ TR924 densitometer in the grey scale step corresponding to a data level of 64 are given in Table 6.

Image Evaluation

The image tone of fresh prints made with the substantially light-insensitive thermographic recording materials of COMPARATIVE EXAMPLE 14 and INVENTION EXAMPLES 11 to 15 was assessed on the basis of the L*, a* and b* CIELAB-values. The L*, a* and b* CIELAB-values were determined by spectrophotometric measurements according to ASTM Norm E179-90 in a R(45/0) geometry with evaluation according to ASTM Norm E308-90. The a* and b* CIELAB-values of fresh prints of the substantially light-insensitive thermographic recording materials of COMPARATIVE EXAMPLE 14 and INVENTION EXAMPLES 11 to 15 for Dmin are also given in Table 6.

In the CIELAB-system a negative CIELAB a*-value indicates a greenish image-tone becoming greener as a* becomes more negative, a positive a*-value indicating a reddish image-tone becoming redder as a* becomes more positive. A negative CIELAB b*-value indicates a bluish tone which becomes increasingly bluer as b* becomes more negative and a positive b*-value indicates a yellowish image-tone becoming more yellow as b* becomes more positive.

TABLE 6

| | | | Print with fresh material | | | | | |
|---|---|---|---|---|---|---|---|---|
| | AgB | mol 10 nm Ag°/mol | $D_{max}$ | $D_{max}$/AgB | $D_{min}$ | $D_{min}$ | CIELAB-values for $D_{min}$ | |
| | g/m² | AgB | vis | [m²/g] | vis | blue | a* | b* |
| Comparative Example nr | | | | | | | | |
| 14 | 4.68 | — | 3.59 | 0.767 | 0.21 | 0.065 | −8.09 | −16.99 |
| Invention example nr | | | | | | | | |
| 11 | 4.89 | 0.001 | 3.97 | 0.812 | 0.21 | 0.075 | −8.22 | −16.34 |
| 12 | 4.65 | 0.01 | 4.33 | 0.931 | 0.24 | 0.144 | −8.65 | −10.6 |
| 13 | 4.94 | 0.01 | 4.29 | 0.868 | 0.23 | 0.153 | −8.60 | −9.74 |
| 14 | 5.02 | 0.01* | 4.29 | 0.855 | 0.24 | 0.130 | −7.11 | −14.25 |
| 15 | 4.84 | 0.01# | 4.46 | 0.921 | 0.24 | 0.128 | −7.02 | −14.19 |

*with 1 mol % vs AgB of p-toluene thiosulphonic acid
#with 2 mol % vs AgB of p-toluene thiosulphonic acid Table 6 shows that the presence of 0.01 mol of added 10 nm silver particles per mol AgB realized a significant increase in the value of Dmax divided by the quantity of the organic silver salt in the thermographic recording material per unit area [g/m²]. The less negative CIELAB b*-values found with 0.01 mol of added 10 nm silver particles per mol AgB, from Table 6, were visually perceptible as a yellowish $D_{min}$. However, the results of Table 6 surprisingly show that this could be counteracted by adding 1 or 2 mol % vs AgB of p-toluene thiosulphonic acid.

COMPARATIVE EXAMPLE 15 AND INVENTION EXAMPLE 16

Preparation of the Type IV Organic Silver Salt Dispersion

The type IV organic silver salt dispersion was produced by grinding 10 g silver behenate produced as described for COMPARATIVE EXAMPLE 14 and INVENTION EXAMPLES 11 to 15 in a 500 mL container 4 g of a 25% by weight 2-butanone solution of BL16, 25.286 g of 2-butanone and 400 g of 1 cm diameter KERAMAG™ ceramic balls for 72 hours. Then 36 g of a 25% by weight 2-butanone solution of BL16, 0.38 g of a 10% solution of Baysilone and 19.009 g of 2-butanone was added and the dispersion further mixed for 2 hours to produce a 21.63% by weight dispersion.

Preparation of the Types V Organic Silver Salt Dispersion

The type V organic silver salt dispersion was prepared by suspending 255.4 g of behenic acid in 750 mL 2-butanone in a 5 litre reactor equipped with pH- and UAg-electrodes. The mixture was heated to 70° C. and stirred at 500 rpm. 950 mL of a preheated 0.75 molar solution (70° C.) of NaOH was then added. The pH rose to 8.74 and the UAg was stabilized at 153 mV. The pH was the further increased to 9.9, whereupon the UAg changed to 149 mV. Behenic acid sodium salt was then converted to the corresponding silver salt, by adding a 0.8 molar aqueous solution of silver nitrate over a period of 4.5 hours using a Midilab Dosage Controller. The conversion was stopped at a UAg of 440 mV and a pH of 6.13. During this conversion the temperature was held at 70° C. After completion of the conversion to the silver salt, 100 mL of a solution containing 405 mg of aldiox in deionised water was added over 65 minutes. At the end of the addition the UAg was almost unchanged, while the pH dropped to 4.91. The mixture was stirred for an additional hour at 70° C. during which the UAg and pH remained virtually unchanged. The silver salt was filtered off at 70° C., washed 3 times with 2.5 L water to remove residual nitrates and forced air dried at 45° C.

The type V organic silver salt dispersion was prepared by grinding 10 g of the resulting silver behenate in a 500 mL container 4 g of a 25% by weight 2-butanone solution of BL16, 25.286 g of 2-butanone and 400 g of 1 cm diameter KERAMAG™ ceramic balls for 72 hours. Then 36 g of a 25% by weight 2-butanone solution of BL16, 0.38 g of a 10% solution of Baysilone and 19.009 g of 2-butanone was added and the dispersion further mixed for 2 hours to produce a 21.63% by weight dispersion.

Preparation of Substantially Light-Insensitive Thermographic Materials

The substantially light-insensitive thermographic materials of COMPARATIVE EXAMPLE 15 and INVENTION EXAMPLE 16 were prepared by adding appropriate quantities of a 50% by weight ethanolic solution containing T01 and T02, a 10% ethanolic solution of the silicone oil Baysilon, 2-butanone, solid R01, R03, S02 and SO3 coating the dispersion on a subbed 115 μm thick transparent poly (ethylene terephthalate} support and drying for 30 minutes at 50° C. to produce a thermosensitive layer with the compositions given in Table 7.

TABLE 7

| | AgB [g/m] | mol aldiox/ mol AgB | BL5-HPZ [g/m$^2$] | T01 [g/m$^2$] | T02 [g/m$^2$] | R01 [g/m$^2$] | R03 [g/m$^2$] | S02 [g/m$^2$] | S03 [g/m$^2$] | oil [g/m$^2$] |
|---|---|---|---|---|---|---|---|---|---|---|
| Comparative Example nr | | | | | | | | | | |
| 15 | 7.791 | — | 7.791 | 0.316 | 0.161 | 1.209 | 1.930 | 0.195 | 0.177 | 0.081 |
| Invention Example nr | | | | | | | | | | |
| 16 | 7.791 | 0.005 | 7.791 | 0.316 | 0.161 | 1.209 | 1.930 | 0.195 | 0.177 | 0.081 |

Thermographic Evaluation

Thermographic evaluation of the substantially light-insensitive thermographic materials of COMPARATIVE EXAMPLE 15 and INVENTION EXAMPLE 16 was carried out as described for COMPARATIVE EXAMPLE 14 and INVENTION EXAMPLES 11 to 15. The results are summarized in Table 8.

Light Box Test

The stability of the image background of the prints made with the thermographic recording materials of COMPARATIVE EXAMPLE 15 and INVENTION EXAMPLE 16 was evaluated on the basis of the change in NCV-values and minimum (background) density and maximum density measured through an ortho, or UV filter using a MacBeth™ TR924 densitometer upon exposure on top of the white PVC window of a specially constructed light-box placed for 3 days in a VOTSCH conditioning cupboard set at 30° C. and a relative humidity of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 PLANILUX™ TLD 36 W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The results are summarized in Table 8.

TABLE 8

| | | Fresh print | | | Lightbox for 3 d/30° C./85% RH | | |
|---|---|---|---|---|---|---|---|
| | mol aldiox/ mol AgB | Dmax vis | $D_{max}$/ AgB [$m^2$/g] | Dmin vis | Dmin (ortho/UV) | CIELAB a* value at D = 1.0 | CIELAB b* value at D = 1.0 |
| Comparative Example nr. | | | | | | | |
| 15 | — | 4.04 | 0.520 | 0.06 | 0.07/0.11 | −0.62 | +2.94 |
| Invention Example nr. | | | | | | | |
| 16 | 0.005 | 4.27 | 0.548 | 0.06 | 0.07/0.11 | −0.47 | +2.31 |

The presence of silver nano-particles resulting from the in situ reduction of silver behenate by the aldiox results in a significant increase in developability as shown by the increase in Dmax and the increase in value of Dmax divided by the quantity of silver behenate in the thermographic recording material per unit area, without adverse effect on light stability of Dmin.

INVENTION EXAMPLE 17 AND COMPARATIVE EXAMPLE 16

Preparation of the Type VI Organic Silver Salt Dispersion

The type VI organic silver salt was prepared by suspending 156 g of HYSTRENE® 9022 and 27.6 g of 1,10-decanedicarboxylic acid in 750 mL 2-butanone in a 5 litre reactor equipped with pH- and UAg-electrodes. The reaction mixture was heated to 70° C. and stirred at 500 rpm. 900 mL of a preheated (70° C.) 0.75 molar solution of NaOH were then added, resulting in a pH of 8.75 and a UAg of 175 mV. The pH was carefully adjusted to 9 using the same 0.75 molar solution of NaOH, whereupon the UAg changed to 185 mV. The mixture of carboxylic acid sodium salts was converted to the corresponding silver salts by adding a 0.8 molar aqueous solution of silver nitrate over 4 hours using a Midilab Dosage Controller. The conversion was stopped at a UAg of 315 mV. During the conversion the temperature was held at 70° C. The precipitated silver salts were filtered off at 70° C., washed 4 times with 2.5 L deionized water containing 2% 1-methoxy-2-propanol to remove residual nitrates. The silver salt was forced air dried at 45° C.

The type VI organic silver salt dispersion was then prepared by grinding 8.72 g of the resulting organic silver salt in a 500 mL container 4 g of a 25% by weight 2-butanone solution of BL16, 25.286 g of 2-butanone and 400 g of 1 cm diameter KERAMAG™ ceramic balls for 72 hours. Then 30.88 g of a 25% by weight 2-butanone solution of BL16, 0.38 g of a 10% solution of Baysilone and 19.009 g of 2-butanone was added and the dispersion further mixed for 2 hours to produce a 21.63% by weight dispersion.

Preparation of the Type VII Organic Silver Salt Dispersion

The type VII organic silver salt was prepared by suspending 156 g of HYSTRENE® 9022 and 27.6 g of 1,10-decanedicarboxylic acid in 750 mL 2-butanone in a 5 litre reactor equipped with pH- and UAg-electrodes. The reaction mixture was heated to 70° C. and stirred at 500 rpm. 900 mL of a preheated (70° C.) 0.75 molar solution of NaOH was then added, resulting in a pH of 8.73 and a UAg of 175 mV. The pH was carefully adjusted to 9 using the same 0.75 molar solution of NaOH, whereupon the UAg changed to 185 mV. The mixture of carboxylic acid sodium salts was then converted to the corresponding silver salts by adding 0.8 molar aqueous silver nitrate solution over 4 hours with a Midilab Dosage Controller. The conversion was stopped at UAg of 315 mV. During the conversion the temperature was held at 70° C. After completion of the conversion to the silver salt mixture, 16 mL of a solution containing 4 mg of aldiox in deionised water was added over 10 minutes. The UAg initially dropped to 308 mV. The mixture was then stirred for an additional hour at 70° C., the UAg increasing again to 328 mV. The precipitated silver salts were filtered off at 70° C., washed 4 times with 2.5 L deionised water containing 2% 1-methoxy-2-propanol to remove residual nitrates and forced air dried at 45° C.

The type VII organic silver salt dispersion was prepared by grinding 8.23 g of the resulting organic silver salt in a 500 mL container 4 g of a 25% by weight 2-butanone solution of BL16, 25.286 g of 2-butanone and 400 g of 1 cm diameter KERAMAG™ ceramic balls for 72 hours. Then 36 g of a 28.92% by weight 2-butanone solution of BL16, 0.38 g of a 10% solution of Baysilone and 19.009 g of 2-butanone was added and the dispersion further mixed for 2 hours to produce a 21.63% by weight dispersion.

Preparation of Thermographic Materials

The substantially light-insensitive thermographic materials of COMPARATIVE EXAMPLE 16 and INVENTION EXAMPLE 17 were prepared by adding to type VI and VII organic silver salt dispersions appropriate quantities of a 50% by weight ethanolic solution containing T01 and T02, a 10% ethanolic solution of the silicone oil Baysilon, 2-butanone, solid R01, R03, S02 and S03 coating the dispersion on a subbed 115 μm thick transparent poly(ethylene terephthalate} support and drying for 30 minutes at 50° C. to produce a thermosensitive layer with the compositions given in Table 9.

TABLE 9

| | AgB [g/m²] | mol aldiox/ mol AgB | BL5-HPZ [g/m²] | T01 [g/m²] | T02 [g/m²] | R01 [g/m²] | R03 [g/m²] | S02 [g/m²] | S03 [g/m²] | oil [g/m²] |
|---|---|---|---|---|---|---|---|---|---|---|
| Comparative Example nr | | | | | | | | | | |
| 16 | 7.791 | — | 7.791 | 0.316 | 0.161 | 1.209 | 1.930 | 0.195 | 0.177 | 0.081 |
| Invention Example nr | | | | | | | | | | |
| 17 | 7.791 | $5 \times 10^{-5}$ | 7.791 | 0.316 | 0.161 | 1.209 | 1.930 | 0.195 | 0.177 | 0.081 |

Thermographic Printing

The thermographic recording materials of COMPARATIVE EXAMPLE 16 and INVENTION EXAMPLE 17 were printed with an external drum printer in which the material is mounted on a drum (200 mm in diameter and 650 mm long) and the Neodymium YAG 1053 nm laser beam laser beam, 15 μm in diameter, was on-off modulated by an opto-acoustic modulator and scanned in a direction perpendicular to the drum rotation direction and parallel to the axis of the drum at a scan speed of 1 m/s. The energy of the laser beam was modulated by modulating the current of the pumping laser diode. The density before printing, Dmin, and the densities after printing as measured with a Macbeth® 924 densitometer with a visible filter are given in Table 10.

TABLE 10

| | | Density realized with the Nd-YAG 1053 nm laser beam | | | | |
|---|---|---|---|---|---|---|
| | Dmin | 100 mW | 150 mw | 200 mW | 250 mW | 300 mW |
| Comparative Example nr | | | | | | |
| 16 | 0.317 | 0.31 | 0.38 | 0.70 | 1.05 | 2.45 |
| Invention Example nr | | | | | | |
| 17 | 0.246 | 0.82 | 2.31 | 4.11 | 4.39 | 4.59 |

The results in Table 10 clearly show that the presence of silver nano-particles due to the reduction of silver salt produced with a mixture of 80 mol % HYSTRENE® 9022 and silver behenate 20 mol % of α,ω-decandicarboxylic acid with 0.005 mol % aldiox with respect to the organic silver resulted in a dramatic increase in developability as shown by the increased densities even with a 100 mW laser beam.

Having described in detail preferred embodiments of the current invention, it will now be apparent to those skilled in the art that numerous modifications can be made therein without departing from the scope of the invention as defined in the following claims.

We claim:

1. A process for preparing a black and white photothermographic recording material comprising a thermosensitive element and a support, said thermosensitive element comprising at least one substantially light-insensitive organic silver salt, an organic reducing agent therefor in thermal working relationship therewith, a toning agent and a binder, wherein said thermosensitive element further comprises deliberately added metal nano-particles in a molar ratio with respect to the total molar concentration of said at least one substantially light-insensitive organic silver salt in the range of 0.05:1 to $10^{-6}$:1, comprising the steps of: (i) mixing a dispersion comprising at least one substantially light-insensitive organic silver salt, photosensitive silver halide, a suspending medium and deliberately added metal nano-particles in a molar ratio with respect to the total molar concentration of said at least one substantially light-insensitive organic silver salt in the range of 0.05:1 to $10^{-6}$:1, wherein said substantially light-insensitive organic silver salt is substantially insoluble in said suspending medium, with a reducing agent and a toning agent; and (ii) coating the dispersion prepared in step (i) on a support.

2. The process according to claim 1, wherein the molar concentration of said deliberately added metal nano-particles in said thermosensitive element with respect to the total molar ratio of said at least one substantially light-insensitive organic silver salt is in the range of 0.005:1 to $5\times10^{-6}$:1.

3. The process according to claim 1, wherein the molar ratio of said deliberately added metal nano-particles in said thermosensitive element with respect to the total molar concentration of said at least one substantially light-insensitive organic silver salt is in the range of 0.002:1 to $10^{-5}$:1.

4. The process according to claim 1, wherein said thermosensitive element further comprises a toning agent.

5. The process according to claim 4, wherein said toning agent is phthalazinone, a phthalazinone derivative, pyridazone, a pyridazone derivative, a benzoxazine derivative or a substituted benzoxazine derivative.

6. A photothermographic recording process comprising the steps of: (i) image-wise exposing to actinic light said thermographic recording material comprising a thermosensitive element and a support, said thermosensitive element containing at least one substantially light-insensitive organic silver salt, photosensitive silver halide and a binder, wherein said thermosensitive element further comprises deliberately added metal nano-particles in a molar ratio with respect to the total molar concentration of said at least one substantially light-insensitive organic silver salt in the range of 0.05:1 to $10^{-6}$:1; (ii) bringing an outermost layer of said photothermographic recording material into proximity with a heat source; (iii) applying heat from said heat source uniformly to said photothermographic recording material in a substantially water-free condition while maintaining proximity to said heat source to produce an image; and (iv) removing said thermographic recording material from said heat source.

7. The process according to claim 6, wherein the molar concentration of said deliberately added metal nano-particles in said thermosensitive element with respect to the total molar ratio of said at least one substantially light-insensitive organic silver salt is in the range of 0.005:1 to $5\times10^{-6}$:1.

8. The process according to claim 6, wherein the molar ratio of said deliberately added metal nano-particles in said thermosensitive element with respect to the total molar concentration of said at least one substantially light-insensitive organic silver salt is in the range of 0.002:1 to $10^{-5}$:1.

9. The process according to claim 6, wherein said thermosensitive element further comprises a toning agent.

10. The process according to claim 9, wherein said toning agent is phthalazinone, a phthalazinone derivative, pyridazone, a pyridazone derivative, a benzoxazine derivative or a substituted benzoxazine derivative.

11. A black and white photothermographic recording material comprising a thermosensitive element and a support, said thermosensitive element comprising at least one substantially light-insensitive organic silver salt, photosensitive silver halide and a binder, wherein said thermosensitive element further comprises deliberately added metal nano-particles in a molar ratio with respect to the total molar concentration of said at least one substantially light-insensitive organic silver salt in the range of 0.05:1 to $10^{-6}$:1.

12. The photothermographic recording material according to claim 11, wherein the molar concentration of said deliberately added metal nano-particles in said thermosensitive element with respect to the total molar ratio of said at least one substantially light-insensitive organic silver salt is in the range of 0.005:1 to $5\times10^{-6}$:1.

13. The photothermographic recording material according to claim 11, wherein the molar ratio of said deliberately added metal nano-particles in said thermosensitive element with respect to the total molar concentration of said at least one substantially light-insensitive organic silver salt is in the range of 0.002:1 to $10^{-5}$:1.

14. The photothermographic recording material according to claim 11, wherein said thermosensitive element further comprises a toning agent.

15. The photothermographic recording material according to claim 14, wherein said toning agent is phthalazinone, a phthalazinone derivative, pyridazone, a pyridazone derivative, a benzoxazine derivative or a substituted benzoxazine derivative.

* * * * *